United States Patent [19]

Beougher

[11] 4,277,100

[45] Jul. 7, 1981

[54] AMBULATORY APPARATUS

[76] Inventor: Gael Beougher, Grinnell, Kans. 67738

[21] Appl. No.: 85,853

[22] Filed: Oct. 18, 1979

[51] Int. Cl.[3] ..... A61H 3/04

[52] U.S. Cl. ..... 297/5; 135/67; 272/70.3

[58] Field of Search ..... 135/67; 297/5, 6; 280/42; 272/70.3

[56] References Cited

U.S. PATENT DOCUMENTS

| | | | |
|---|---|---|---|
| 1,917,440 | 7/1933 | Finkbeiner | 135/67 X |
| 2,129,260 | 9/1938 | Bowser | 297/6 |
| 3,180,678 | 4/1965 | McCabe | 297/5 |

*Primary Examiner*—Karl J. Bell

[57] ABSTRACT

Ambulatory apparatus for assisting an invalid is disclosed which includes a rigid frame on which is carried at least three wheels. A brake shoe cooperates with at least one of the wheels. The brake shoe is biased into engagement to limit the movement of the walker unless the bias is manually overcome or locked out of engagement.

4 Claims, 5 Drawing Figures

AMBULATORY APPARATUS

BACKGROUND OF THE INVENTION

The invention relates to apparatus for assisting those persons who cannot walk without special apparatus. More particularly the invention relates to apparatus intended to support the weight of a person and at the same time make it possible for them to propel themselves about by their feet and thus acquire some mobility. The apparatus ordinarily will have wheels.

The prior art includes various apparatus which include wheels for supporting the weight of a person. A problem with such apparatus is that the person using such apparatus often cannot readily limit the forward motion of the apparatus. Some such known apparatus include brakes which are manually operated. Even this known apparatus, however, can be quite dangerous when used by a person who may have relatively weak hands particularly when the apparatus is used on a sloping surface. Sloping surfaces or ramps are, of course, widely used at the intersections between sidewalks and streets and also to bypass steps.

It is an object of the invention to provide apparatus which will provide greater safety for the user when used on such sloping surfaces.

It is another object of the invention to provide apparatus which will enable the user to have greater control over the braking of such apparatus.

Still another object of the invention is to provide apparatus which will be inexpensive and easy to manufacture.

Yet another object of the invention is to provide apparatus which will allow unrestricted movement if the operator desires such a manner of operation.

SUMMARY OF THE INVENTION

It has now been found that these and other objects of the invention may be attained in an ambulatory apparatus or walker for assisting an invalid which includes a rigid frame having at least three wheels carried on the frame. A brake shoe cooperates with at least one of the wheels. The brake shoe is biased for urging the shoe into engagement to limit rotation of the wheel with which it cooperates.

In one form of the invention the apparatus further includes means for locking the shoe away from one wheel so that the shoe does not limit rotation of the wheel.

Means for locking may comprise an elongated handle which is pivotally mounted on the frame and has a central bore. A bracket may be carried on the frame and a pin engages the bracket in the central bore to hold the handle in a position where the brake shoe does not contact the wheel with which it cooperates. Ordinarily the apparatus will have four wheels and each of the front wheels will be provided with substantially identical braking mechanisms. The other two wheels will be caster mounted.

The apparatus may further include a seat carried on the frame to support the user. The seat may further include depending elongated fingers for mounting.

BRIEF DESCRIPTION OF THE DRAWING

The invention will be better understood by reference to the accompanying drawing in which.

DESCRIPTION OF A PREFERRED EMBODIMENT

Figure 1:
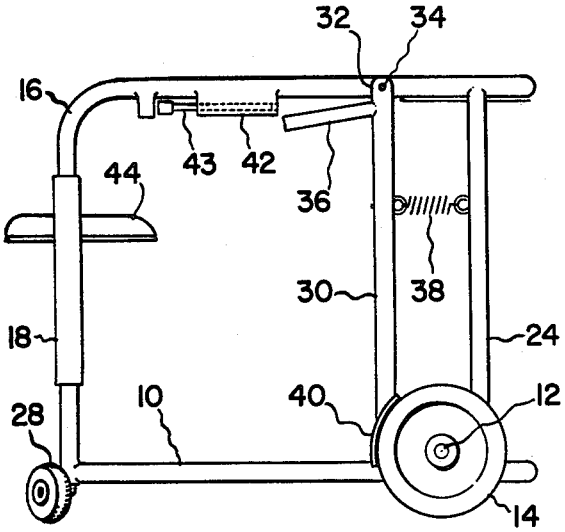
FIG. 1 is a side elevational view of one embodiment of the invention.
Figure 2:
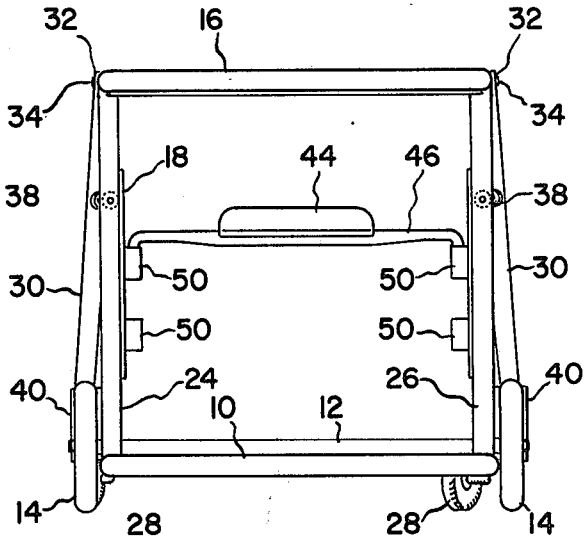
FIG. 2 is a front elevational view of the embodiment of FIG. 1.

Referring now to FIGS. 1, 2, 3, and 4 there is shown a walker or ambulatory apparatus in accordance with one form of the invention. The apparatus includes a generally u-shaped bottom rail 10. Carried on top of the bottom rail 10 is an axle 12 which carries wheels 14, 14 at the ends thereof. Ordinarily a single rail 16 will extend upward from one extremity of bottom rail 10, then horizontally toward the front of the apparatus, then horizontally toward the opposite side, then rearward and finally down to the other extremity of the bottom rail 10. In one form of the invention the rail 16 is provided with a concentric tube 18 on the vertical portion thereof. The purpose of this tube 18 will be described hereafter.

Extending intermediate the horizontal portions of the rail 16 is a third rail 20 which together with rail 16 supports a planar tray 22. Vertical support rails 24, 26 extend between bottom rail 10 and rail 16 at the front of the apparatus. Caster mounted rear wheels are provided at the extremities of bottom rail 10.

An elongated member 30 includes a yoke 32 which is pivotally mounted by pin 34 on rail 16. An extension of the elongated member 30 identified by the numeral 36 serves as a handle. The handle 36 has in one form of the invention a hollow central bore (not shown). A coil spring 38 is preferrably connected between the elongated member 30 and the vertical rail 24 to bias the bottom extremity or shoe of the elongated member 30 against a cooperating wheel 12. Ordinarily a separate pivotally mounted elongated member 30 will cooperate with each of the two front wheels, 14, 14. Carried on the rail 16 proximate to each of the handles 36 is a sleeve 42 which accommodates a pin 44 which is axially moveable between a position which registers with the central bore of the handle 36 when the handle is positioned proximate to the rail 16.

Figure 4:
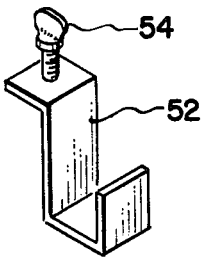
FIG. 4 is an elevational view of a bracket which is suitable for holding the seat shown in FIG. 3 when the seat is not in use.
Figure 3:
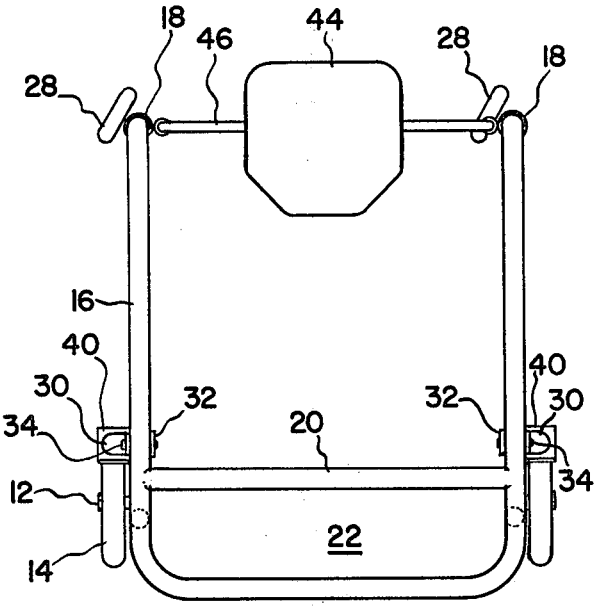
FIG. 3 is a plan view of the embodiment of FIG. 1 further including a seat.
Figure 5:
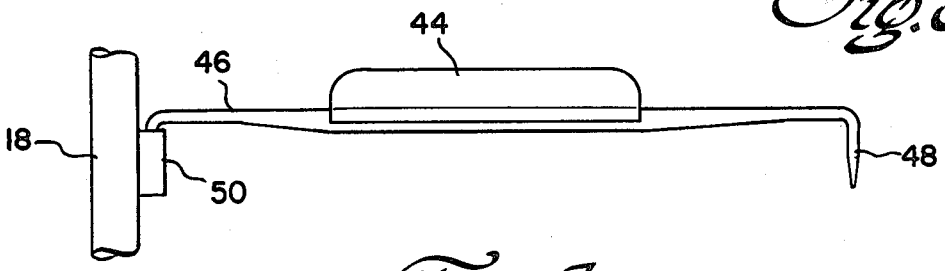
FIG. 5 is a partial rear elevational view of the apparatus shown in FIG. 3.

Referring now to FIGS. 3, 4, and 5 there is shown a seat 44 which is carried on a horizontal bar 46 having depending fingers 48 which cooperate with support members 50 disposed on the circumference of the concentric tube 18. Ordinarily a plurality of support members 50 will be provided along the concentric tube 18 at a plurality of axial positions. This plurality of support members 50 enables the seat 44 to be readily adjusted to accommodate users of varying heights.

Bracket 52 shown in FIG. 4 is provided with a screw 54 which cooperates with the holes (not shown) adjacent to the tray 22 in the rail 16 to hold the seat 44 when it is not in use and not positioned as shown in FIG. 3.

In operation, the user may withdraw the pins 44 to allow the elongated member 30 to pivot in response to the force imposed by the spring 38 to limit the freedom of rotation of the wheels 14. In this mode of operation the danger of the apparatus moving in an uncontrolled manner is minimized. For use on terrain that is more level it may be desired to lock the elongated member 30 in a position with the shoe spaced away from the wheel 14 with which it cooperates. For those applications where the user is readily able to operate the handle 36 against the bias of the spring 38 the pin 44 will also be withdrawn from engagement with the central bore of the handle 36.

To accommodate users having various heights the front wheels 14 may be replaced with wheels having different diameters. Ordinarily the connection between the rails will be made by welding, brazing, bolting or other known joining techniques. The user has the option of removing the seat on those embodiments which include a seat and hanging it on the front of the apparatus or leaving it detached. The use of the combination of relatively large front wheels and swivel mounted rear wheels enables the user to easily maneuver the apparatus. The manner of joining the spring 38 to the elongated member 30 and the rail 24 may vary. In some embodiments cotter keys may be used. In others eye bolts may be used and in still others other known means may be provided. In some embodiments of the invention plastic or rubber may be provided on at least axial portions of the tubing which are touched by the user particularly those portions which are used to maneuver the walker.

Having thus described my invention I claim:

1. A walker for assisting an invalid which comprises a rigid frame, at least three wheels carrying said frame, a brake comprising a shoe dimensioned for engagement with the periphery of one of said wheels, said shoe cooperating with at least said one of said wheels, biasing means for urging said shoe into engagement with said one of said wheels to limit rotation of said one wheel, means for locking said shoe away from said one wheel and against said biasing means so that said shoe does not limit rotation of said one wheel, said means for locking comprising an elongated handle pivotally mounted on said frame and having a generally transverse bore, said means further including a bracket carried on said frame and a pin engaging said bracket and said generally transverse bore when said handle is moved against said biasing means to prevent limitation of rotation of said wheel.

2. The apparatus as described in claim 1, wherein said apparatus includes a fourth wheel and at least two of said wheels are caster mounted.

3. The apparatus as described in claim 2, wherein said apparatus further includes a seat carried on said frame.

4. The apparatus as described in claim 3, wherein (said seat further includes elongated depending finger.)

* * * * *